US006698636B2

(12) United States Patent
Angus et al.

(10) Patent No.: US 6,698,636 B2
(45) Date of Patent: Mar. 2, 2004

(54) WAIST POUCH

(75) Inventors: June Angus, 1823 12th Ave. West, Seattle, WA (US) 98119; Keith Willows, Seattle, WA (US)

(73) Assignee: June Angus, Seattle, WA (US)

( * ) Notice: Subject to any disclaimer, the term of this patent is extended or adjusted under 35 U.S.C. 154(b) by 0 days.

(21) Appl. No.: 09/966,775

(22) Filed: Sep. 27, 2001

(65) Prior Publication Data

US 2002/0134809 A1 Sep. 26, 2002

Related U.S. Application Data

(60) Provisional application No. 60/236,424, filed on Sep. 28, 2000.

(51) Int. Cl.[7] ..... A45F 3/00

(52) U.S. Cl. ..... 224/660; 224/662; 224/680; 224/684

(58) Field of Search ..... 224/148.1, 148.3, 224/148.4, 148.6, 651, 250, 904, 930, 660, 662, 680, 934, 681, 682, 684

(56) References Cited

U.S. PATENT DOCUMENTS 4,569,465 A * 2/1986 O'Farrell ..... 224/660
4,648,130 A * 3/1987 Kuznetz ..... 224/181
4,871,597 A * 10/1989 Hobson ..... 224/148.3
4,991,573 A * 2/1991 Miller
5,176,131 A * 1/1993 Votel et al.
5,244,136 A * 9/1993 Collaso ..... 224/901.6
5,353,975 A * 10/1994 Libertucci ..... 224/662
5,517,696 A * 5/1996 Krugler ..... 224/901.8
5,645,205 A * 7/1997 Kennedy ..... 224/934
5,909,834 A * 6/1999 Parrott, III ..... 224/660
6,065,154 A * 5/2000 Hulings et al.
6,325,262 B1 * 12/2001 Thompson ..... 224/628

* cited by examiner

*Primary Examiner*—Nathan J. Newhouse
(74) *Attorney, Agent, or Firm*—Black Lowe & Graham, PLLC

(57) ABSTRACT

A moisture/heat channeling/wicking and vented waist pouch or pack adapted for use by an individual wherein the pack can be worn securely around the waist specifically to contain and/or carry items such as; personal electronics, cell phones, music electronics and any other personal items needed. The pack is secured to the waist by means of two waist straps attached to both ends of a pouch container element comprised of front and rear panels attached at their periphery with a recloseable opening and/or plurality of pockets to insert items to be contained. The front side and rear panels use moisture wicking and ventilation enhancing materials, constructed, connected and configured together creating evaporative channels which take or remove moisture absorbed through the back panel of the pouch, from the users body, and channels it for evaporation, through airation, to areas of the pouch which do not touch the users body directly. The main container or pouch includes, at the face or front panel, a flat vertical strip of elastic webbing or strapping, providing means for inserting an object's concave, or recessed area between the container and the strap with means to receive and tightly hold the inserted object against the front panel of the container.

20 Claims, 9 Drawing Sheets

SECTION C-C

SECTION C-C

WAIST POUCH

CROSS REFERENCE—RELATED PROVISIONAL PATENT APPLICATION

This application relates to priority of Provisional Patent Application, No. 60/236,424, filed on Sep. 28, 2000. Applicants Keith S. Willows and June A. Angus of Seattle, Wash. Provisional Patent Application Title: "Waist Pouch".

BACKGROUND

1. Field of Invention

The present invention relates to a waist pouch or waist pack, specifically to such pouches or packs which are used to contain and/or carry items such as; personal electronics, cell phones, music electronics and any other personal items needed.

2. Description of Prior Art

Sport shops and general merchandise stores sell waistpacks, backpacks and other bags for carrying personal electronics and any items the user wishes to carry with them while engaging in sports, fitness or any day-to-day activities such as shopping etc. Prior to this invention, there were generally two types of fannypacks/waistpacks to enable the user to carry and/or contain such items for convenience. These two types include: General waist packs made of denure nylon—(non-stretch standard backpack material of different grades/thicknesses/denure) with zippered pockets (or other means) for separating and organizing desired items to be carried. These waist packs generally include nylon (non-stretch) waiststraps, or shoulder straps, and/or a buckle to secure the pack to the user's waist. These types of waistpacks/fannypacks are generally used for non-sports activities—such as generally day to day use—like a purse, travel, or generally purpose carrying bag. The second type of pack, a sports cassette carrying waistpack—was introduced for sports use in the 1970's and 80's to better carry radio's and cassette players and other essentials while jogging, going to the gym etc. These sports specific music and water bottle carrying waistpacks are primarily made of neoprene (rubber sandwiched between/laminated to layers of thin lycra, nylon or polyester), and/or denure nylon material. Some of these may also be hand carried, using a strap that fits over the users hand which is connected to the pouch whereas the item to be carried is held in the palm of the users hand. These sports pouches and packs made carrying these cassette players and the like more convenient as they were cushioned and could be worn tight on the body to help prevent bouncing of the contents. Both of these existing pouch/pack types have drawbacks for both general day-to-day use and for sports use. Both feel hot and can generate and trap sweat on the user, while under certain use conditions, may not fully protect contents, and do not provide the maximum amount of comfort possible—due to heat, and/or chafing and digging into the users body/skin. Some waist pouches/packs and backpacks have encorporated some air permiable materials on the back or sides of these products, which may allow less sweat or heat saturation, but do not achieve the benefits provided by the new and novel features of the invention describe herein.

OBJECTS AND ADVANTAGES

Several objects and advantages of the present invention are:

a) to provide a waistpouch/waistpack which can be produced easily, and economically b) to provide a separate fully cushioned/protective custom fitting main pocket or "cradle" for delicate personal electronics—in one embodiment, protecting such items enclosed from moisture, dust and sweat c) to provide a cooler, airier, and thus more comfortable pouch/pack due to unique breathable, moisture wicking and air circulating features and elements d) to provide, in one embodiment, separate and fully breathalble compartments for additional small essentials like keys e) to provide pouch features such that sunglasses and additional items can be attached conveniently to the outside of the waistpouch/waistpack e) to provide a more comfort for the user via combinations of cushioning, given breathable and moisture wicking materials types and pouch/pack construction design

DRAWING FIGURES

The enclosed drawings are informal. Formal drawings will be supplies as needed.

Figure 11:
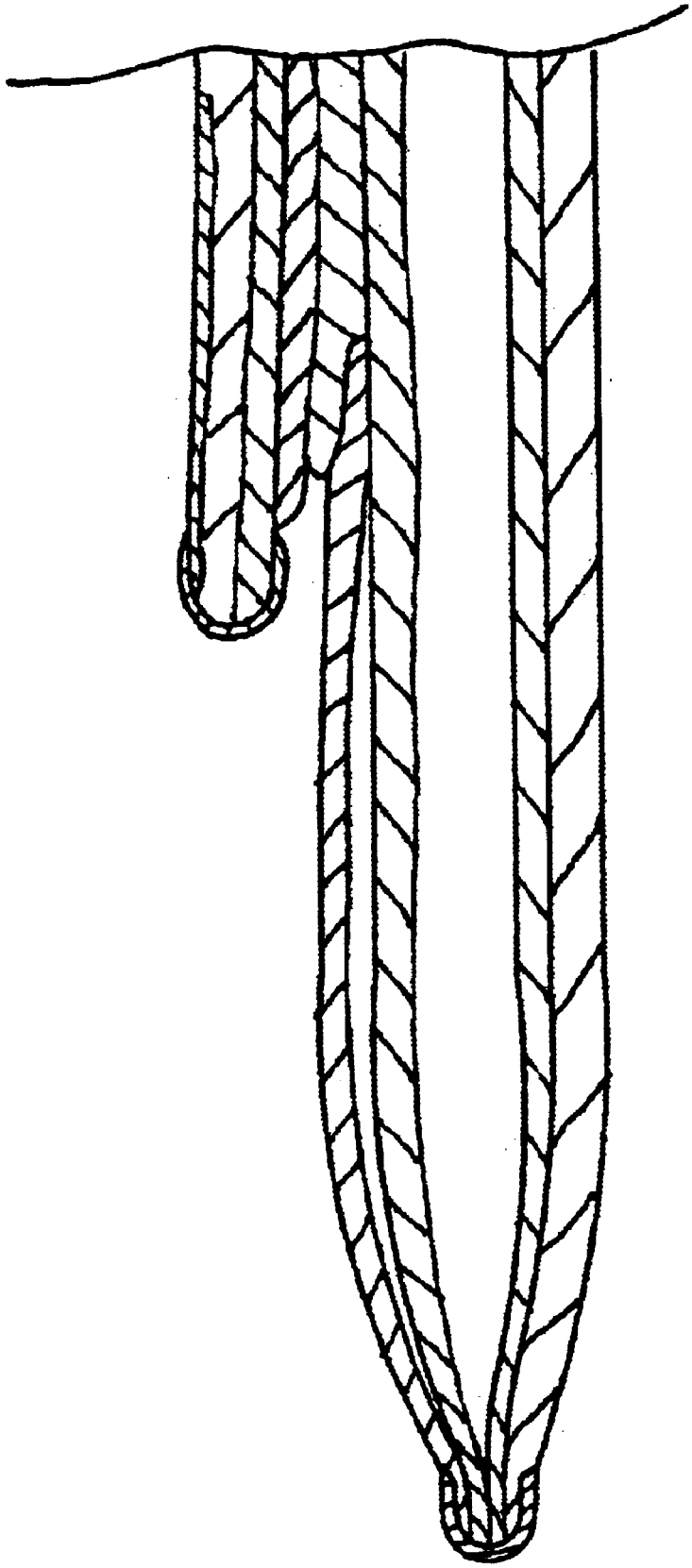
Figure 12:
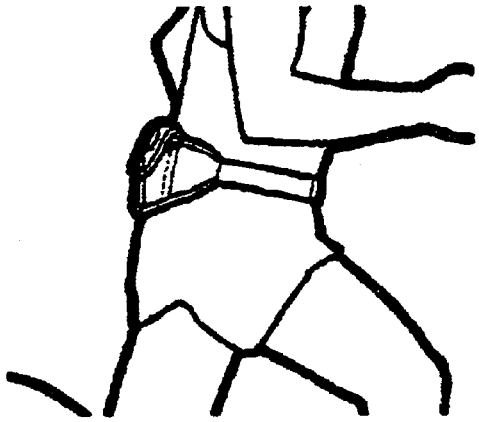
Figure 13:
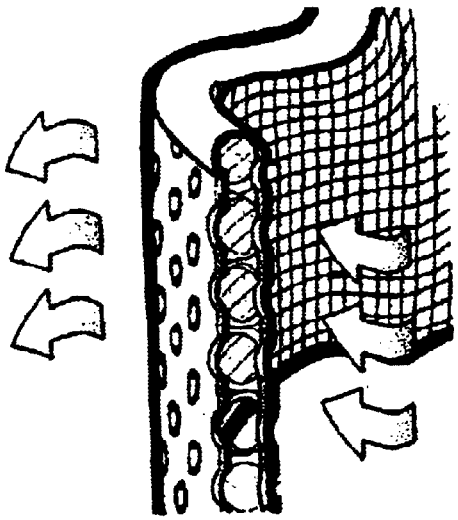
Figure 14:
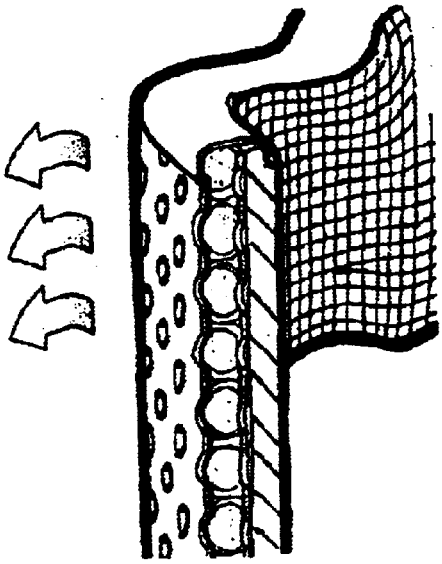
Figure 15:
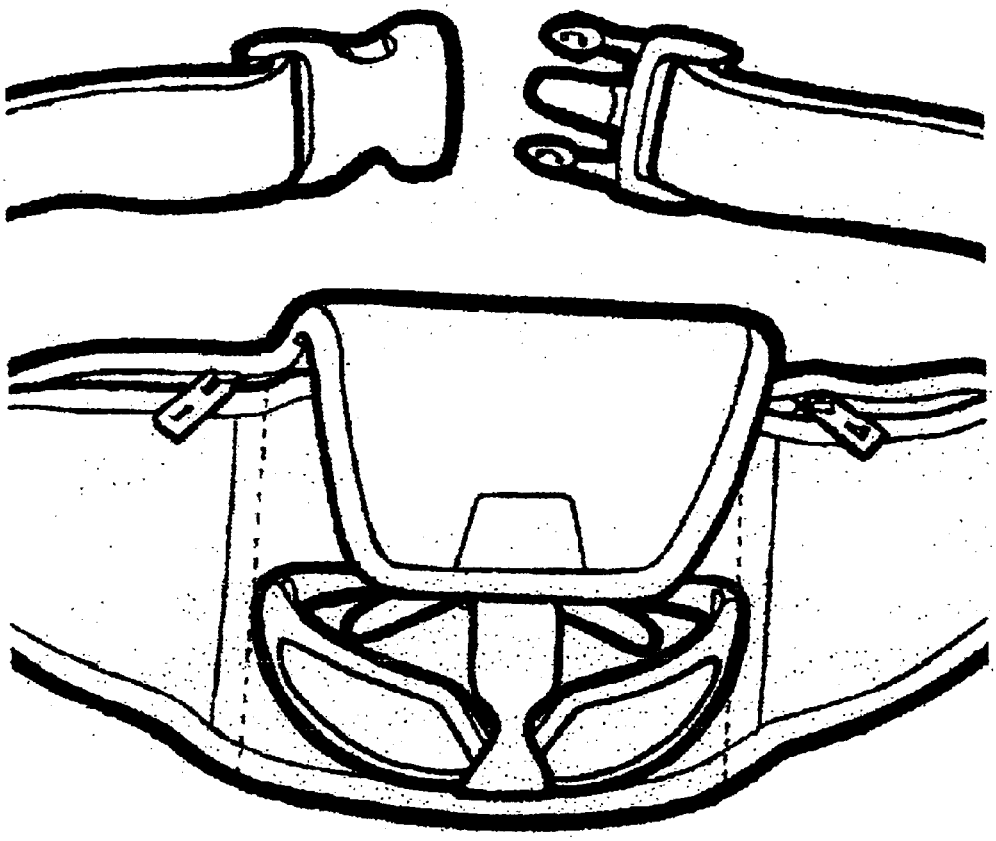
Figure 18:
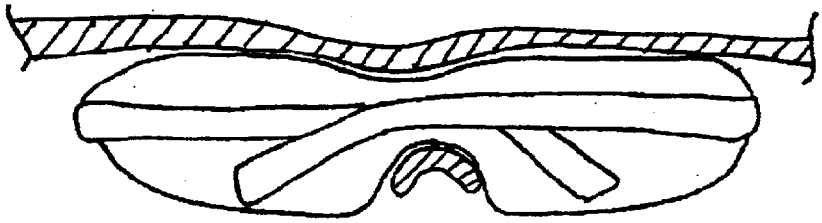
Figure 17:
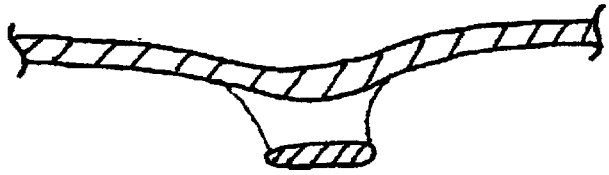
Figure 16:
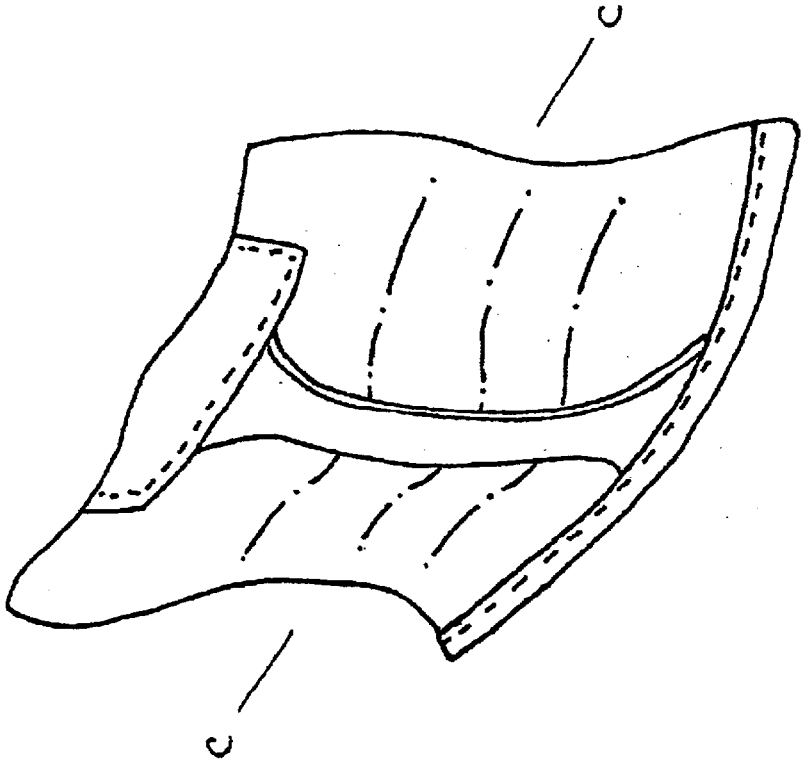

FIG. 11 is a partial, left side elevational view, which shows one recommended configuration and related approximate length of the sunglasses/accessory strap feature FIG. 12 shows a user wearing one configuration of the invention with arrows indicating the direction of moisture wicking and airflow FIG. 13 shows one type of cushion mesh material that can be used FIG. 14 shows one type of cushion mesh material (as shown in FIG. 13) with an accompanying panel of moisture resistant/cushioned laminate panel FIG. 15 is a partial front elevational view of one embodiment of the invention showing a one recommended way in which a pair of sunglasses may be attached to the pack/pouch via the "sunlasses/accessory" strap FIG. 16 is a partial top elevational view of the main front panel of the pouch/pack showing how the front panel may be formed, contoured and/or fabricated to further accommodate the safe attachment and carrying of specific items such as for sunglasses shown FIG. 17(Section C—C) is a cross sectional, top elevational view of FIG. 16, further showing a contour area fabricated into the front panel to help further secure sunglasses FIG. 18 shows Section C—C of FIG. 17, with sunglasses in place cradled and held securely between the contoured front panel of the pack and the sunglasses/accessory strap

SUMMARY

In accordance with the present invention a waistpouch comprises in one embodiment, a main moisture protective and cushioned pocket(s), fully breathable and moisture wicking sides, moisture wicking back panel and moisture wicking front panel(s) components, stretchable body attachment straps or other attachement means, and in one embodiment, separated extra pocket(s) for carrying additional small essentials.

PPA—Description—FIGS. 1 to 18

The following discloses a waist pouch and integrated accessories strap for carrying personal items or the like. The waist pouch and accessories strap herein described are believed to be individually unique and novel as well as unique and novel integrated together. The preferred embodiment of the inventions described herein is a waist pouch with integrated accessories strap.

The waist pouch alone (if accessories strap is ignored for the moment) described and pictured in the enclosed FIGS. 1 through 15 was designed to be cool and light, easily manufacturable from readily available materials, inexpensive to produce, as well as function better and more comfortably than currently available waist pouches. The waist pouch described herein accomplishes the above mentioned traits in a number of ways, using light, comfortable materials. The main waist strap is preferably made from stretchy/soft material like the breathable nylon stretch material used in suspender straps, stretch waistbands and the like, but also many other materials can be used (any material that can be suitably formed/cut into a strap can obviously be used). The waist straps may be eliminated in another embodiment being replaced by u-clips or hairpin type clips to fasten the users waistband or the like. A number of suitable clamps or clips such as over-center biased clamps like suspender clips, standard belt clips, etc. There are number of benefits associated with eliminating waist straps such as the elimination of chafing, weight reduction, less user confinement, etc. The main pouch pockets themselves are preferably made from soft slightly stretchy material like neoprene (wetsuit material) and breathable cushioning fabric/material and the like commonly used in shoe uppers and many other applications. The waist pouch is novel in that it combines both cushioning waterproof/resistant materials (like closed-cell wetsuit neoprene) and breathable mesh materials together in a novel way so that the main pouch protects objects from sweat and moisture, dust, etc., (objects that need to be kept dry like radios, cell phones, etc.) while the whole pack/pouch remains breathable and cool by wicking moisture away and allowing airflow. These two seemingly incongruous features are accomplished by constructing the back panel of the pouch partially out of both wicking cushion mesh and moisture proof/resistant cushioning material (preferably wetsuit neoprene)—see FIGS. 8,9,14). However the pouch can be molded of hard or soft plastic or the like and laminated in various configurations with the cushioning and mesh component within the spirit of the invention. The wicking/cushioning/readily breathable mesh is preferably put on the full exterior of the back panel of the pouch (which is worn next to the wearer's body), a water-proof/resistant panel/material(s) preferably wetsuit neoprene or the like is fastened/laminated on the other side of the wicking material in a smaller area sufficient in size to line the full inside portion of the main pocket—see FIGS. 8–14. Also the front center panel of the pouch is made of a preferably similar material (moisture proof/resistant wetsuit neoprene or the like). This combination of materials and fastening of these materials in the depicted manner allows the main pocket to protect it's contents from sweat/moisture. Providing the evaporation panels, (see FIGS. 8, 9, 10) allows the moisture to be drawn out from behind the main pocket through the front side (evaporation) panels as well as through the front cushion mesh portion of the front of the front flap (see FIGS. 8,9,10). The wicking cushioning mesh material not only allows circulation of air but draws the moisture away from its surface (and away from the body) while allowing evaporation. (This type of wicking cushioning mesh is readily available as well as can be easily manufactured from laminations of one or more layers of mesh/breathable fabric—that can be hydrophobic—and one or more cushioning layers made from open-cell foam or other open cell material—that can be hydrophilic.) Non-cushioned mesh can also be used for the front side evaporation panels with similar air circulating/cooling results. But, it is preferable for the back panel(s) to be this cushioning mesh (with neoprene or the like inset/laminated/affixed pocket area) because non-cushioned mesh not only does not cushion the wearer from the contents of the pockets (potentially hard, sharp objects like keys and the like) but it does not provide an adequate path to draw moisture away from the body and transport it to the evaporation panels so that the pack performs the desired cooling/comfortable effect. The front side panels are also preferably cushioning mesh because it is often more economical to duplicate material use in manufacturing as well as the cushioning mesh also provides protection for and from the items in the formed pockets and cushions and conforms around these contained items inhibiting their movement so they don't bounce and jingle around when the waist pouch is in use and may be more comfortable against the body.

The waist pouch provides at least three significant paths to wick away moisture. 1) the front of the front flap provides a large area for evaporation and thus moisture evaporates from this panel and because it is the same connected panel as the back panel which is against the wearer's body this evaporation pulls moisture from the back panel (in a wicking effect) to replace the moisture that evaporates from the front of the front flap. This wicking effect is analogous to a flame lantern burning oil—as the oil is burned from the flame, more oil is wicked up from the reservoir replacing the oil that was burned and thus feeding the flame until the oil is consumed. In the case of the described waist pouch, moisture/sweat is evaporated from the outside of the pack in at least three places (as well as the breathable waist straps) this lost/evaporated moisture is replaced by moisture wicked from against the wearer's body. The moisture which was wicked away from the users body was heated by the wearer's body and as this moisture is pulled away it brings the heat with it and thus the wearer feels a cooling effect. 2)

Moisture is not only pulled up from the back panel to the front of the front panel to be evaporated but it is also pulled sideways (or laterally) as moisture is evaporated from the side panels. Moisture travels through the mesh front side panels and this causes another (lateral) wicking action from the central area of the rear back panel to the right and left sides of the rear back panel and then this moisture is evaporated through the front side panels. (see FIGS. 8 & 9 for a diagram of three of the wicking paths)

FIG. 12 shows how when the wearer of the wicking waist pouch runs or walks this causes a slight vacuum behind the wearer further pulling moisture away from the waist pouch and thus causing a more pronounced wicking/cooling effect for the wearer. The waist pouch wicks moisture and thus pulls heated moisture away from the body (and thus the wearer feels cooler than if the moisture has little or no path to be wicked away offering a much more comfortable feel than a product made out of virtually unbreathable materials such as neoprene and supplex material and nylon (even if small holes are punched in it resulting in a material that is slightly breathable but allows little evaporation to occur.

Another less desirable configuration of this cooling waist pouch uses a lamination of wicking cushion mesh/fabric or the like and closed cell neoprene or waterproof/resistant material extending for the full surface of the back panel. The mesh side would go against the body. This is gives you some wicking/evaporation action from the back panel to the front of the front flap, but is inferior to the above preferred embodiment because it provides only one evaporation panel and does not take advantage of multiple areas for evaporation and thus would provide inferior cooling.

Another embodiment would use a lamination/combination of cushion mesh-type material with moisture proof/resistant backing not only for the rear panel but for the full front panel as well (the moisture proof/resistant material would only line the main pocket area and not extend beyond that) The side front cushion mesh panels would extend over top of the front center moisture proof/resistant panel and provide another area/panel for evaporation. The use of cushioned mesh or a cushioned moisture proof/resistant center pocket liners could be exchanged respectively with non-cushioned mesh and non-cushioned water resistant/proof liner depending on the desired cushioning of the pouch. And obviously these four different kinds of fabrics can be mixed and matched depending on the desired cushioning and wicking effect within the scope and spirit of the outlined invention.

Figure 2:
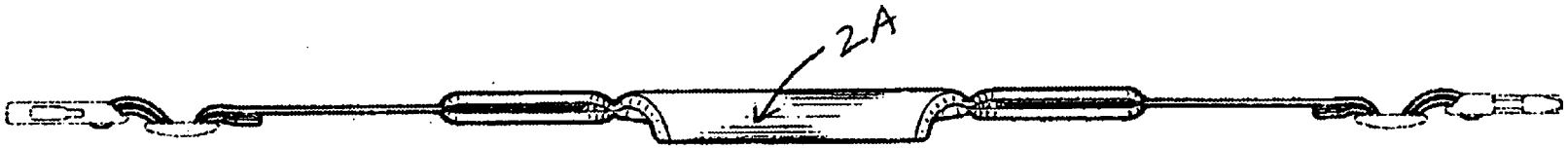
FIG. 2 is a top view of one the same configuration (FIG. 1) of the waistpouch
Figure 3:
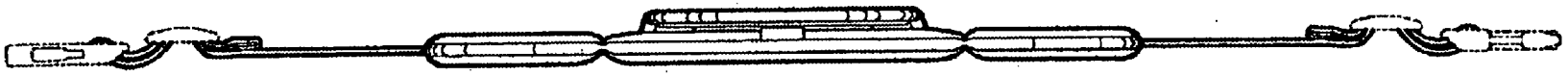
FIG. 3 is a bottom elevational view of the same configuration (FIG. 1) of the waistpouch.
Figure 5:
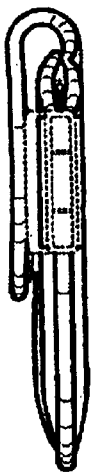
FIG. 5 is a left side elevational view of the same configuration (FIG. 1) of the waistpouch.
Figure 4:
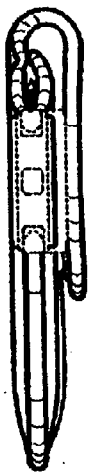
FIG. 4 is a right side elevational view of the same configuration (FIG. 1) of the waistpouch.
Figure 6:
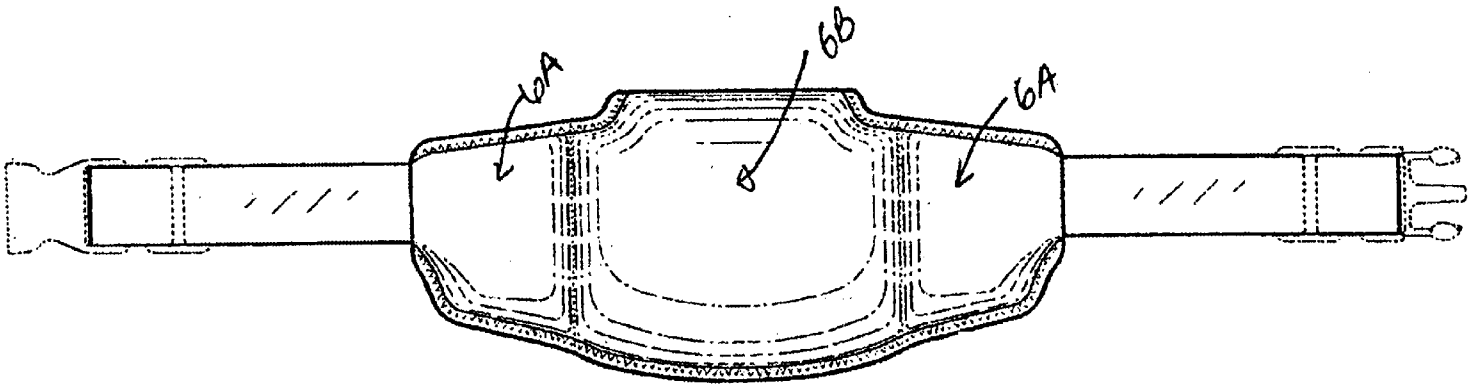
FIG. 6 is a back elevational view of the same configuration (FIG. 1) of the waistpouch, showing the back middle panel, back side panels and the waiststraps of the waistpouch
Figure 10:
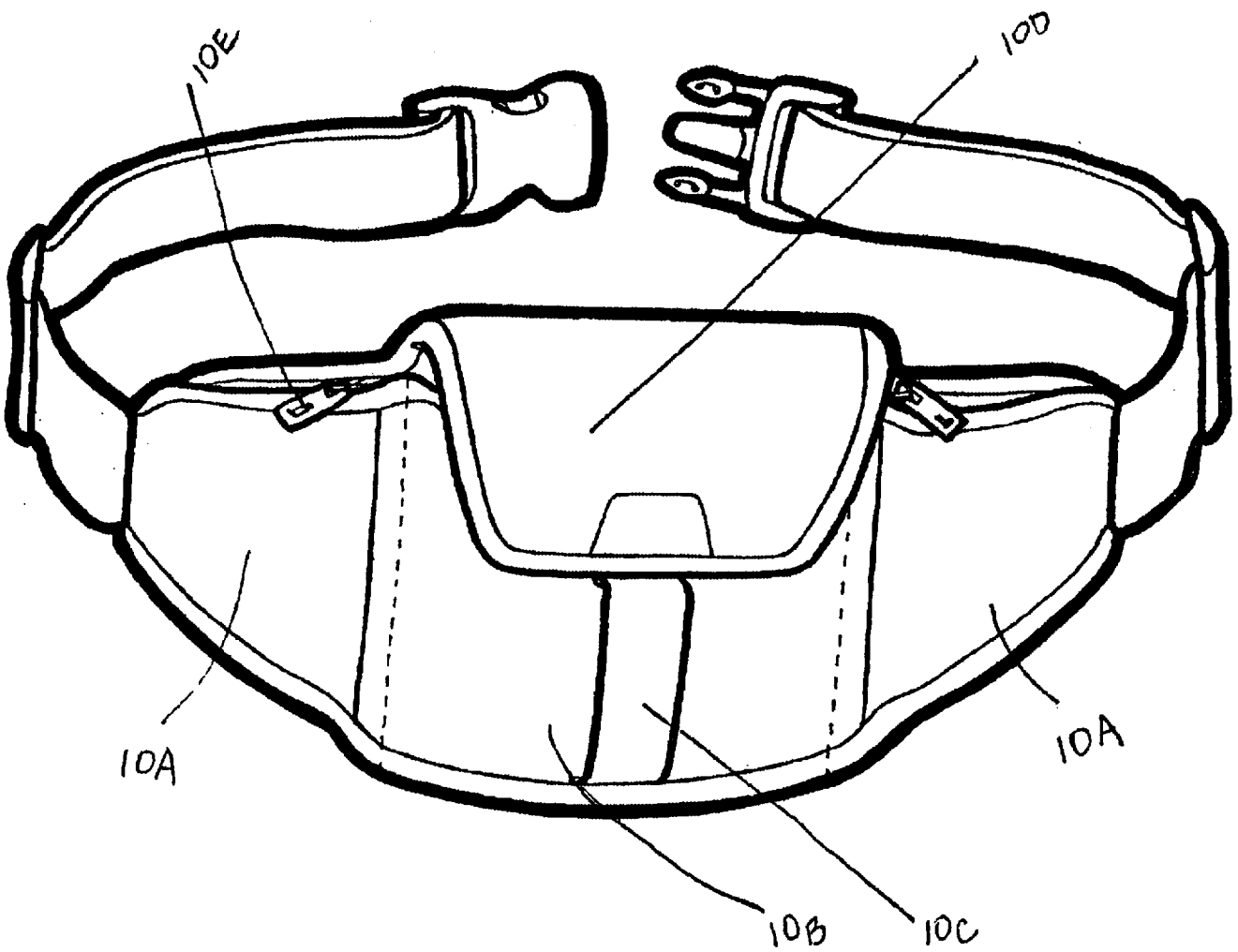
FIG. 10 is a front elevational view showing the evaporation panels located on the sides, and front flap of the invention, the front center moisture resistant panel and the sunglass/accessory strap.

Pouch/pocket closures are depicted in the following figures. The closure for the main center pocket is preferably a Velcro-like fastening system as shown on FIG. 7 in the double hatched areas. For the side pockets, zippers are preferable and are represented in FIGS. 2 and 10. These fasteners are shown but should not be considered the only appropriate fasteners. Buttons, hooks, snaps, etc. also could be used as well as many other systems. Attachment of fasteners to pocket openings can be accomplished in any number of ways including sewn in place, glued, riveted, molded in place, etc.

Description of Sunglasses/Accessories Strap

The sunglasses strap itself is a simple yet novel solution for securing/carrying sunglasses and other like items on the outside of the waist pouch so that they can be easily accessed while the waist pouch is in use. The strap system consists of a flexible slightly or significantly stretchy strap, fixed at both ends to the waist pouch (or it could be fixed to a bag or other item). The central non-fixed area of the strap must be of a specific length range for the strap to be conveniently useable for sunglasses which is the primary and preferred use for the strap (but still one of many possible uses). Also the strap must be stretchy enough but not too stretchy to hold sunglasses or other items firmly in place. The preferred material for the sunglasses strap is the same or similar material that is used in suspender straps and stretch waistbands in slip-on sport pants.

Although it could be much less desirable and thus not preferred because of higher costs of manufacturing and poorer aesthetics, it may be constructed using any stretchy or non-stretchy fabric/material which can be adjusted and fastened (& unfastened) in the middle (or other place) to accommodate a variety of items a user may wish to carry (such as a towel). The fastener may be Velcro or two strips that connect using a male/female buckle or clasp with a variety of features for adjustment commonly used on straps.

The orientation of the stretch strap is preferably vertical so the glasses or other like item are held horizontally (see FIG. 15). This allows the user of the sunglasses strap to exercise/move without fear of the glasses or other item being jerked out of the holder by the jogging/bouncing of the user.

The preferred length of the strap is such that it is fixed at both ends resulting in the desired length to snugly accommodate an item to be carried . . . for sunglasses this dimension is about from 2 to 3.25 inches with an optimal length of about 2.5 inches. This optimal length number for most wrap sunglasses varies with the stretch/firmness of the strap as well as with the geometry of the surface that the strap is affixed to (the shape and contour of the surface between the two fixed ends), and the attributes of the material/substrate that the two ends of the strap are affixed to as well as the attributes of the material in between where the strap is affixed. For example—if the strap is fixed on a stiff substrate the strap length may have to be adjusted shorter or longer than on a flexible/soft substrate to hold the item securely. The stretchiness of the strap takes up any differences between sunglasses geometry as well as allows for much variability of the surface between the fixed ends (which can vary when different size/shape items are placed in the main pocket or whatever is behind the strap). Thus the sunglasses or other item can be held firmly in place under the strap.

The contour of the surface under the strap can be used to help lock the item to be carried in place. An example of a surface contour that may be desirable to more firmly hold sunglasses in place is shown in FIGS. 16–18. This contour could be heat/pressure formed in place, molded or another separate piece/part could be added to form this contoured feature. Also a well-like or concave feature can be incorporated to more firmly hold the accessory/sunglasses in place.

Also the strap itself can be contoured as FIG. 16 shows. A contoured strap can aid in holding the carried item more firmly in place.

The preferred width of the strap is from 0.5 to 1.25 inches with an optimal width of about 0.75 inches (and the above length range) for suspender strap-type material holding most or all wrap-style sunglasses. The width is important for holding the sunglasses firmly in place—too thin and it doesn't hold the glasses straight and firm and too wide and the glasses don't really lock in place (The width is important so that the strap fits snugly in the nose/brow area of the glasses. The shape of most/all glasses are similar in this are so that they fit snugly on the nose and against the face. Thus the simple stretch strap sunglasses holder works for many different sunglasses types, sizes and shapes. The width of the strap is picked so this width fits snugly in the nose/brow area of the glasses. (see FIG. 15)

FIG. 15 shows how the strap is used with the preferred style wrap sunglasses.

The strap as configured in the following drawings (and above described) is also optimal for manufacturing. The feature of a sunglasses holder is very simply and efficiently added to a bag or other appropriate item with the addition of a small, inexpensive and readily available piece of stretch strap.

A very important and commercially desirable aspect of incorporating this feature into the shown the waist pouch is that it is simple and adds virtually little or no cost (just the cost of a small piece of stretch strap) to the manufacturing of the bag. In the enclosed drawings the strap is fixed on the top end by sewing, gluing, fastening or molding, etc. it into the Velcro or other like fastener in the same step that the Velcro is sewn in place as well as the other end (bottom) is sewn in place as the edge binding of the waist pouch is put on. Thus, a very useful and marketable feature can be added to a bag or other item with minimal cost. Also the cut ends of the stretch strap are covered and bound in this way with no added cost.

This feature can, but does not have to define the distance between the two sewn-into-the-bag ends. The desired length of 2 to 3.25 inches of free strap can be achieved by cutting the strap piece slightly larger that the desired free length and fixing/sewing the strap between two feature with less distance than this by just bowing up the strap. The reverse, putting a strap between two features with more distance than this, can be accomplished by sewing or fastening, riveting, etc somewhere between these two fixed ends so that the resulting free strap is within this length range.

There are many other ways of attaching a small piece of stretch strap at both ends so that the desired sunglasses attachment/access feature is achieved. A strap could be riveted in place, glued, formed woven, etc.

Also, the stretch strap material can be covered with material in such a way as the attachment/access feature is not hindered, thus covering the elastic strap if desired for aesthetic reasons.

Physical Description—Construction (as Seen in Drawings)

A typical embodiment of the waistpouch of the present invention is illustrated in FIGS. 1-18. The waist pouch encorporates a front panel consisting of areas identified in FIGS. 1A, 1B and 1C, a back panel consisting of areas shown in FIGS. 6A and 6B, 7A and 1C, waist attachment means, for the waistpouch, shown here, in one embodiment of the invention, in the form of a waiststrap illustrated in FIG. 1D with associated waiststrap fastening means as illustrated in FIG. 1E.

Front Panel—Center Area

Figure 1:
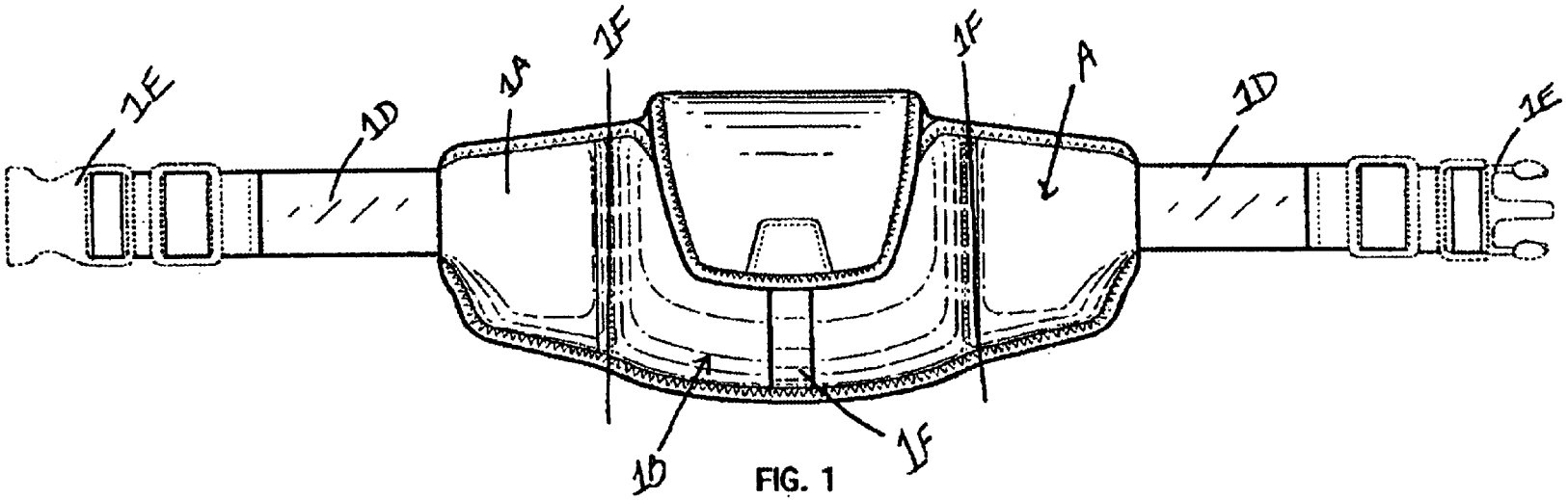
FIG. 1 is a front elevational view of one configuration of the invention (waistpouch), showing the front middle, front-side panels and waiststrap elements of the waistpouch
Figure 8:
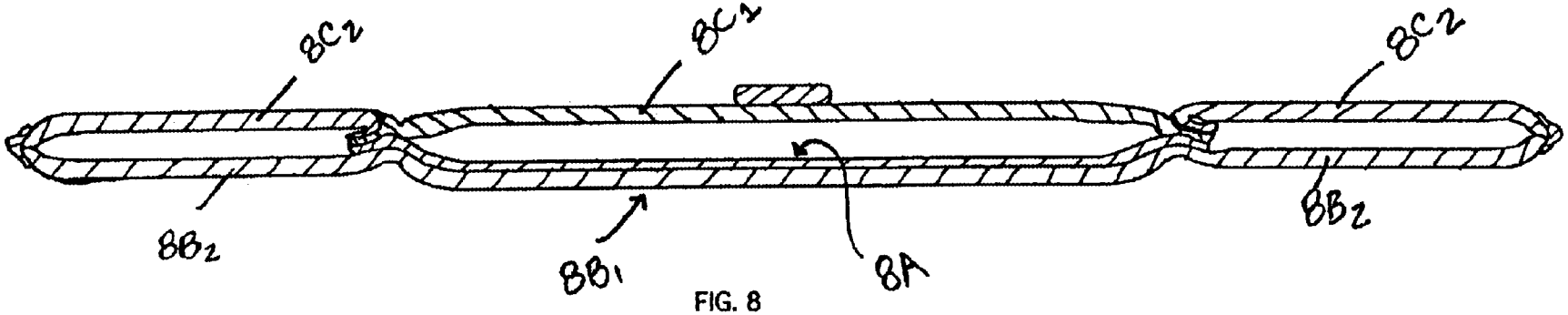
FIG. 8 is a cross sectional view, of a top elevational view of the invention, showing the locations of the "wicking" material or the like (in blue), and the moisture resistant material (in red) and the location of the sunglasses/accessory strap (in green).
Figure 9:
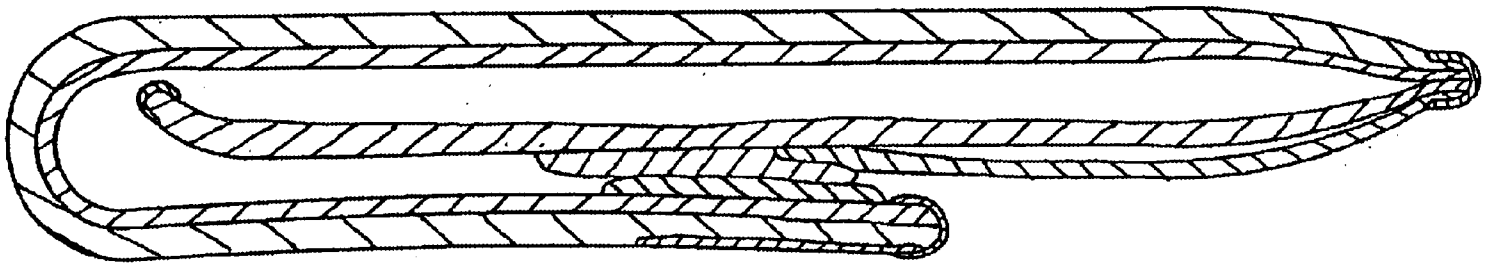
FIG. 9 is a cross sectional view, of the left side elevational view of the invention, showing the locations of the "wicking" material or the like (in blue), and the moisture resistant material (in red), and the location of the sunglasses/accessory strap (in green).

The front panel/view of one embodiment of the invention is shown in FIG. 1 consisting of a center area labeled in FIG. 1 as 1B and two side areas labeled in FIG. 1 as 1A. The front panel itself can be a variety of sizes and shapes to suit various needs. One shape for the front panel is shown in FIG. 1. The center area, 1B may be constructed using one or two layers of preferably maliable material. A cross section of a typical embodiment of the waistpouch is shown in FIG. 8. The front panel center area in FIG. 8 is labeled 8C1, and each side panel 8C2. The 8C1, center area of the front panel may be made with one or more layers of a material that is impermiable or semi-impermiable to moisture such as neoprene, rubber, leather, nylon, polyester or the like. It is preferably maliable, but may be rigid as well. Although it may not be preferred for this embodiment, the center area 8C1 (shown in red) in FIG. 8C1, may be a permiable material such as punched impermiable materials of the type listed above, or air/moisture permiable mesh type materials of nylon, cotton, polyester, pvc and the like. Additionally, this center area of the front panel shown in 8C1 can also be a combination of an impermiable material like neoprene on one side and an mesh like or air/moisture permiable fabric on the otherside—mated by lamination, gluing or stitching, grommiting, or the like.

Front Panel—Side Areas

The side areas of the front panel shown in 1A, and in cross section form in FIG. 8C2 extend substantially horizontally, but may include a vertical incline or a combination, to the sides from the center area of the front panel. These side areas FIG. 8C2 can be constructed using a single layer of mesh material, which comprises one or more thin layers of preferably soft, maliable, breathable mesh material or the like (made of cotton, nylon, polyester or pvc, or the like. In which case, at least two layers of material is used, one thin may be laminated or otherwise joined to, a layer of a breathable and wicking material providing a "wicking/seperating element", which in combination with the back panel areas 6B, allow for moisture/sweat to move through panel 6B to be held in this wicking (hydrophillic) material away from the body as it evaporates away from these areas 1A. This wicking element may be made of materials such as open cell foam, nylon, polyester, or other woven or non-woven fibers or the like. Also, this "wicking element" can be used alone without a mesh backing, laminated to a layer of mesh (hydrophobic, or not), sandwiched between two layers of mesh or the like., etc. An example of this two layer mesh separated by a seperating element is shown in FIG. 13 and described as "cushion mesh". This material preferably used on the side areas, of the front panel, shown in FIG. 1A and will be referred to as "cushion/wicking mesh" and is shown in FIG. 13. However, as mentioned above, these front panel side areas FIG. 8C2, may consist of a single layer of breathable material such as woven or non-woven mesh or the like. Additionally, as discussed later, these front panel side areas, FIG. 8C2, may be eliminated, while still providing the novel features claimed.

Back Panel—Center Area

Figure 7:
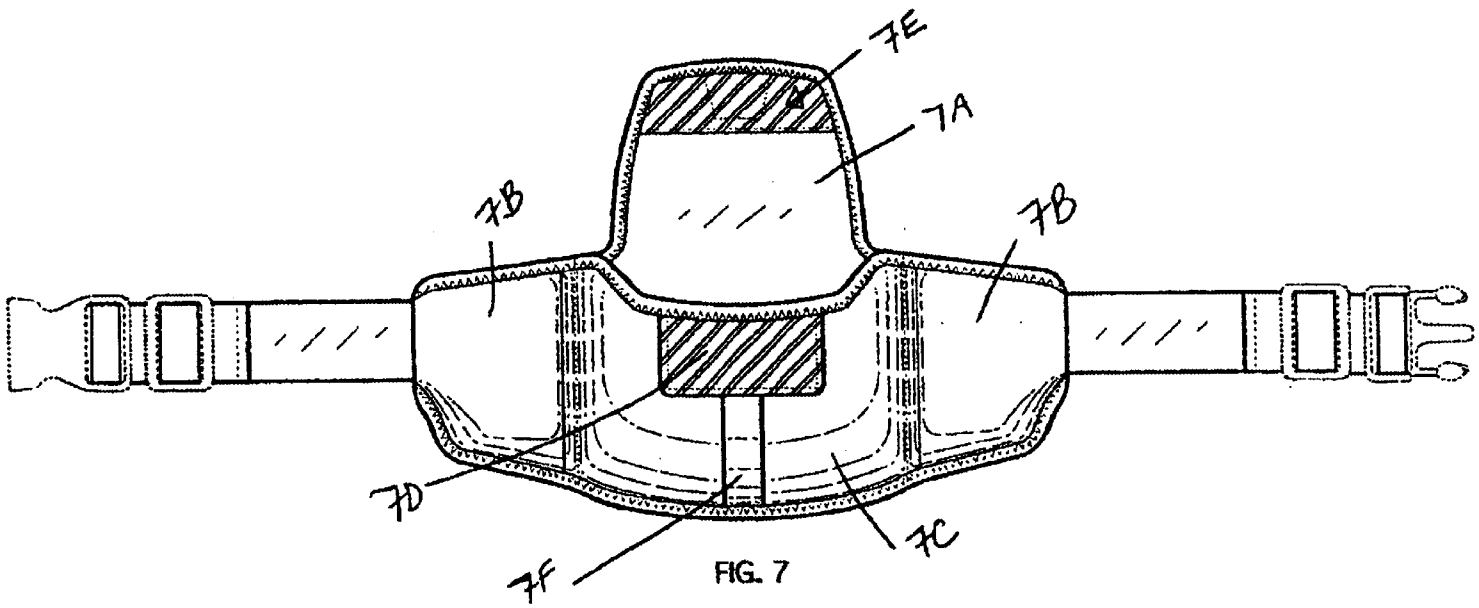
FIG. 7 is a front elevational view of the same configuration (FIG. 1) of the waistpouch, shown with the front main pocket flap open.

The back panel of the waistpouch, shown in FIGS. 6A and 6B may be made similarly to the front panel previously described, in terms of material make up, size and shape, and location of types of material, however, the backside of the back panel (the backside of the back panel—being that side which would sit against the users back in a typical wearing configuration) center portion requires the inclusion of at least one layer of the above described "cushion/wicking mesh" material providing a wicking and airrating evaporation panel extending upward from the center portion of the back panel, as shown from the front side (or inside) of the back panel, in FIG. 7A. This "cushion/wicking mesh" panel extending upward in FIG. 7A, from the backpanel of the waistpouch, is preferably lined or backed with a moisture resistant material, on the inside of the pouch, but may be backed solely with a breathable and wicking material as mentioned above, have no backing, or utilize any combination thereof of breathable or air/moisture impermiable materials. The upward extension of the center back panel may be sewn, connected or attached to the center area of the back panel from a separate piece of material, or it may be made in one piece with the back panel not requiring any seam or connection between the two. FIG. 2, a top view of the waistpouch, shows in a preferred embodiement of the invention, whereas the back panel evaporation extention folds over the top of the front panel center area, as shown in a front view in FIG. 7, covering the opening to the waistpouch created by the mating of the front to back panels of the waistpouch as indicated later. The extention of the back panel may also achieve the same effect extending the wicking material from the back of the pouch under the bottom of the center area of the pack to the front of the pack, either perminantly secured or openable like the over the top extention flap noted above. Therefore this extention may exist simulateously over the top of the pouch from the back and under the bottom to the front of the pack, or utilize one or the other as indicated in a preferred embodiment in FIG. 1C. Note: In order to take full advantage of this wicking/transporting of moisture out from behind the pouch and away from the body, any connection of parts/material from the back of the pouch (against the users body) to the front or sides preferably allows for these wicking paths to stay as open as possible so that the wicking action is not impeded for example by certain types of sewn seams, or changes in material parts or types. A one piece construction, with or without seams, of wicking material for the full back panel, is preferable.

Back Panel—Side Areas

The side areas of the back panel shown in FIG. 6B, and in cross section form in FIG. 8B2, extend substantially horizontally, but may include a vertical incline or a combination, to the sides from the center area of the front panel. These side areas 8C2 can be connected to the center area of the back panel via sewing or the like, or may be constructed in a single piece if material with the center area of the back panel The side areas, FIG. 8B2, must be constructed using one of the three below configurations:

either a single layer of "cushion/wicking mesh"—which comprises at least two thin layers of preferably soft, maliable, breathable mesh material or the like (made of cotton, nylon, polyester or pvc, or the like, whereas each thin mesh layer sandwiches, or encorporates in-between a layer of a breathable and wicking material providing a "seperating element", between the two thin layers of mesh. This layer of a seperating and wicking element may be made of materials such as open cell foam, nylon, polyester, or other woven or non-woven fibers or the like. This seperating element serves to hold the two thin mesh layers apart enough to allow additional air inbetween the two mesh layers of the front side panel material and provides additional moisture wicking/evaporation benefits. An example of this two layer mesh separated by a seperating element is shown in FIG. 13 and described as "cushion mesh". Example= Aero spacer drilex mesh or the like.

Or a single layer of a breathable mesh like material laminated or connected to another layer of cushioning, moisture permiable, breathable material such as open cell foam or the like. (The likely more durable mesh or mesh like material would be preferably located on the outside surface for increased durability of the invention for specific uses).

Or a layer of one material which incorporates elements which provide both cushioning and air permiability such as open cell foam or the like.

Note: In order to take full advantage of this wicking/transporting of moisture out from behind the pouch and away from the body, any connection of parts/material from the back of the pouch (against the users body) to the front or sides preferably allows for these wicking paths to stay as open as possible so that the wicking action is not impeded for example by certain types of sewn seams, or changes in material parts or types. A one piece construction, with or without seams, of wicking material for the full back panel, is preferable.

Mating of Front/Back

The front panel, of the preferred embodiment, as shown in FIGS. 1A and 1B, and again in FIGS. 7B and 7C, are mated on the periferal sides or edges, to the those matching parts of the back panel shown in FIGS. 6A and 6B. These are attached via sewing, standard edging processes or other means which allow them to stay permanately or removeably attached at the edges as shown. As shown in lines indicated in FIG. 1F, the side (moisture wicking/breathable) areas may be seperated from the middle, moisture resistant area by stitching along lines shown in FIG. 1F., in the preferred embodiement. With this, a center middle area moisture resistant "pocket" is created, and two cushioned and/or breathable/wicking side areas. If the front side panels are included, as mentioned above as one configuration of the waistpouch, then when mated or connected at their perifery, two breathable side area "pockets" are present as both the front and back panel side areas are mated at their perifery providing for the side pocket option. These side pockets may be secured at their top by zippers as shown in FIG. 10E, or using other openable/closeable fastening means such as velcro, buttons, snaps, etc.

Additionally, the side areas, shown in FIGS. 1F and 6A, may be present on the front and back panels of the waist pouch, stiched around the perifery as indicated above to create two breathable side pockets, with a zipper or other closure means for each side pocket, or as suggested above, the side panel areas may be eliminated from the front panel, allowing the breathable, evaporative and wicking action intended from the back panel side areas of the waistpouch, but not providing for the side area storage pockets which using side panels on both the front and the back panels provide for. Both these configurations provide the novel feature of the side evaporation and wicking panel, but one or the other, may be desireable for different uses. If one doesn't need additional carrying space, such as in the side pockets, then a lighter waistpouch can be achieved by eliminating these in some cases. However, if more carrying space is desired, they, the side pockets, may exists, but still allow for the primary moisture wicking, breathability and evaporation intended from the pack panel, utility intended in the scope of the invention.

Extension Flap/Back Panel

The evaporation, moisture wicking flap constructed as part of the back panel as shown in FIGS. 7A and 1C, may encorporate on it's backside (or inside) some fastening material or means such as velcro, snaps, buttons, etc., or the like to allow it to be removably mated to the outside or front side of the front panel, FIG. 7C. One preferable location and configuration of this fastening material is indicated by the diagonal lined areas in FIGS. 7D and 7E. FIG. 1C, shows the pack panel extension flap folded over the front panel main pocket in the fastened position providing a moisture resistant middle "pocket" for desired use as described above and below.

Waist Straps/Buckle

The preferred waistpouch attaches to the users waist via waiststraps and buckles shown in FIGS. 1D and 1E, or via clips that are removably or permanently attached to the body of the waistpouch, preferrably the back side of the back panel of the waistpouch, in one or more locations—whereas these clips, clamps (Hairpin clips, overbiased "suspender style" clamp/clips, or alligator style biting clamps, whereas the clips allow the backpanel and the whole waistpouch to be removeably attached to the waistband of the users clothing such as pants, shorts or skirt. This type of clip is used in a similar manner as described above, and proven in a similar way in a previous invention of the inventors.

If waiststraps are preferred, as shown in FIG. 1, among other figures, they may be attached to the periferal sides of the side panels of both the front and back panels, or attached to the periferal sides of either the front, or back side panels, and mated using conventional buckles as shown in FIG. 1E or such other means as velcro, buttons, straps, clamps, laces or belt buckle style closure.

Sunglasses/Accessory Strap

A thin (not very wide) vertical stretchy strap or thin double straps may be sewn on the top edge to the top (middle panel) area of the front panel of the waistpouch, shown in FIG. 7F, preferrably to the bottom edge of hook and loop fastener shown in FIG. 7D., and may be connected at the bottom end to the edge of the waistpouch, forming a stretch strap which securely receives the indented nosebridge of sunglasses and holds them securely as shown in FIG. 15. This strap may contain molded, contoured or formed elements which further aid in the containment of articles such as sunglasses, a cap, electronics or other items which may be desireably carried on the outside of the waistpouch. This contoured element of the vertical article retainment feature of the waistpouch is further shown in FIGS. 16, 17 and 18.

Operation—FIG. 12

The manner of using the waistpouch in this invention is similar to the way in which one would put on or utilize any other type of fannypack, or waistpack/pouch—however, the unique features and related user benefits are the primary differentiating factors.

Pulling up on the main flap of the front pouch/pocket of the pack, any item or electronic device can be inserted into the projective main center pocket. The top flap to that pocket can then be secured to tightly cradle the object inside. Additional items may be inserted into the side pockets as needed via opening the zippers, or other closures, and as well, the sunglasses or other items such as a cap, jacket, t-shirt etc., may be inserted or slid under the sunglasses/accessory strap feature as seen in FIG. 15. For sunglasses, FIG. 15 shows how the sunglasses/accessory strap fits snugly into the nosebridge indentation of the sunglasses conveniently and provides for a secure and bounce resistant position. Then, holding the waistpouch, using ones hands, by the waiststraps, one would position the main pouch/pack in the center of their lower back, with the opening to the main pocket to the outside, or most easily accessible pocket opening position, wrapping the waiststraps around each hip and attaching the waiststraps together via velcro, buckle or other mating device. The mating of the straps can occur in any location on the pack or body, not limited to the belly button area, which has been standard to date. FIG. 12 shows a side view of a jogger wearing the pack in a standard configuration. Any item(s) may be also inserted, or removed from the pack alternatively while it is in the wearing position on the body, versus, before it is attached around the waist as described above. If in another described configuration clips are used to attach the pouch to the users apparel waistband, the clips would be inserted over the waistband or clamped to the waistband, while attached to the pouch/pack. The pockets of the pouch/pack would be accessed as described above as used with a pouch waist strap.

Summary, Ramifications, and Scope

Accordingly one can see that the novel waistpouch described herein can be used to securely, protectively, comfortably, and conveniently allow the user to carry and contain electronics and other personal items while engaging in sports and/or leisure activities. Furthermore, the waist pouch described herein has the additional advantages it that:

a) it can be made using easy and economic production processes, techniques and materials
b) the invention, in a preferred embodiment, provides a separate fully cushioned/protective custom fitting main pocket or "cradle" for delicate personal electronics—protecting such items from moisture, dust and sweat
c) it provides a cooler, airier, and thus more comfortable pack due to unique breathable, moisture wicking, evaporative, and air circulating features on the back, front and sides of the invention while still maintaining the moisture and general protection desired for important items contained in the main pocket
d) it provides, in one embodiment, for fully breathable/air flow-through side components for cooling comfort and at the same time efficiently offers separate secure compartments of additional storage space for small essential items
e) it provides optimal outside, item attachment features that permit the non-bouncing, storage, secure attachement, and easy removal of additional items such as sunglasses, a cap, jacket and other additional items
e) it provides to the user an overall more comfortable general use, and sports performance enhancing way of carrying needed items (eliminating bouncing, jingling etc., heat build up) via combinations of cushioning, breathability, evaporation of moisture, and moisture wicking materials types and pouch/pack construction design and features.
f) is an aesthetically superior means of providing and integrating all the above mentioned technical product features and related user benefits

What is claimed is:

1. A waist pack, comprising:

a waist panel formed from moisture wicking material, the waist panel having a front side, a back side, a first end, and a second end;

a first strap attached to the first end of the waist panel, the first strap including a first fastener;

a second strap attached to the second end of the waist panel, the second strap including a second fastener adapted for releasable attachment to the first fastener; and a pouch attached to the front side of the waist panel, the pouch further having a front pouch panel, a back pouch panel, and a flap attached to the back pouch panel, the flap being removably fastenable to the front pouch panel to enclose the pouch, and further wherein the front pouch panel, back pouch panel, and flap are each formed from a moisture resistant material.

2. The waist pack of claim 1, wherein the waist panel is formed from a single, continuous piece of material where it is in contact with the pouch.

3. The waist pack of claim 2, wherein the waist panel further comprises a waist panel flap and wherein the waist panel flap is attached to and covers substantially all of the pouch flap, the waist panel and waist panel flap being formed from a single continuous piece of material, whereby moisture in the area of the waist panel is drawn toward the waist panel flap where it may be evaporated away.

4. The waist pack of claim 2, wherein the waist panel further comprises a waist panel flap and wherein the waist panel flap is attached to and covers at least a portion of the pouch flap, the waist panel and waist panel flap being formed from a single continuous piece of material, whereby moisture in the area of the waist panel is drawn toward the waist panel flap where it may be evaporated away.

5. The waist pack of claim 4, further comprising a strap attached to the pouch, the strap being sized to retain a pair of sunglasses.

6. The waist pack of claim 5, wherein the strap is formed form an elastic material.

7. The waist pack of claim 4, further comprising a first side pocket adjacent a first side of the pouch, the first side pocket being formed from moisture wicking material.

8. The waist pack of claim 7, further comprising a second side pocket adjacent a second side of the pouch, the second side pocket being formed from moisture wicking material.

9. The waist pack of claim 8, wherein the first side pocket comprises a front panel and a back panel, and further wherein the first side pocket back panel is formed from the single, continuous piece of material that forms the waist panel.

10. The waist pack of claim 9, wherein the second side pocket comprises a front panel and a back panel, and further wherein the second side pocket back panel is formed from the single, continuous piece of material that forms the waist panel.

11. The waist pack of claim 10, wherein the first strap and second strap are adjustable and are formed from an elastic material.

12. A waist pack, comprising:

a waist panel formed from moisture wicking material, the waist panel having a front side, a back side, a first end, and a second end;

a first strap attached to the first end of the waist panel, the first strap including a first fastener;

a second strap attached to the second end of the waist panel, the second strap including a second fastener adapted for releasable attachment to the first fastener; and a moisture resistant pouch attached to the front side of the waist panel, the pouch further having a top, a bottom, a first side, and a second side, wherein at least a portion of the moisture wicking material of the waist panel extends beyond at least one of the top, bottom, first side, or second side.

13. The waist pack of claim 12, wherein at least a portion of the moisture wicking material forms a flap that extends over the top of the pouch.

14. The waist pack of claim 12, wherein the moisture resistant pouch further comprises a flap attached to the top of the moisture resistant pouch and configured to enclose the pouch, and further wherein at least a portion of the moisture wicking material is attached to the flap.

15. The waist pack of claim 14, further comprising first side pocket adjacent the first side of the pouch, the first side pocket being formed from moisture wicking material.

16. The waist pack of claim 15, further comprising a second side pocket adjacent the second side of the pouch, the second side pocket being formed from moisture wicking material.

17. The waist pack of claim 16, wherein the first side pocket comprises a front panel and a back panel, and further wherein the first side pocket back panel is formed from at least a portion of the moisture wicking material that forms the waist panel.

18. The waist pack of claim 17, wherein the second side pocket comprises a front panel and a back panel, and further wherein the second side pocket back panel is formed from at least a portion of the moisture wicking material that forms the waist panel.

19. The waist pack of claim 18, wherein the first strap and second strap are adjustable and are formed from an elastic material.

20. The waist pack of claim 19, further comprising a strap attached to the pouch, the strap being sized to retain a pair of sunglasses.

* * * * *